United States Patent [19]

Morin

[11] Patent Number: 4,762,603

[45] Date of Patent: Aug. 9, 1988

[54] PROCESS FOR FORMING ELECTRODES

[75] Inventor: Louis G. Morin, Tarrytown, N.Y.

[73] Assignee: American Cyanamid Company, Stamford, Conn.

[21] Appl. No.: 50,066

[22] Filed: May 13, 1987

Related U.S. Application Data

[60] Division of Ser. No. 604,397, Apr. 26, 1984, Pat. No. 4,680,100, which is a continuation of Ser. No. 507,604, Jun. 24, 1983, abandoned.

[51] Int. Cl.[4] ..... C25B 9/00; C25C 7/00; C25D 17/10; H02G 15/02

[52] U.S. Cl. ..... 204/279; 204/280; 204/284; 204/286; 204/290 R; 174/74 R; 439/874

[58] Field of Search ..... 439/874, 875, 883; 204/280, 279, 28, 290 R, 284, 286; 174/74 R, 75 R, 90

[56] References Cited

U.S. PATENT DOCUMENTS

| | | | |
|---|---|---|---|
| 3,622,283 | 11/1971 | Sara | 29/183.5 |
| 4,046,663 | 9/1977 | Fleet et al. | 204/280 |
| 4,046,664 | 9/1977 | Fleet et al. | 204/280 |
| 4,108,754 | 8/1978 | Fleet et al. | 204/263 |
| 4,108,757 | 8/1978 | Fleet et al. | 204/294 |
| 4,132,828 | 1/1979 | Nakamura et al. | 428/366 |
| 4,356,075 | 10/1982 | Case | 204/280 X |

*Primary Examiner*—Donald R. Valentine
*Attorney, Agent, or Firm*—Michael J. Kelly

[57] ABSTRACT

The invention includes electrodes having a plurality of fibers wherein an essentially continuous metallic coating of high bond strength extends over at least a portion of each fiber, and wherein the fibers provide a large surface area. The electrodes of the invention have an efficient electrical connection at their terminals comprising fiber/metal matrices which provide the desired connections to the terminals without damage to the fibers. The fiber metal matrices also provide excellent electrical contact between all of the fibers, and inhibit wicking of the electrolyte or process stream into the electrical connections. Where the fibers are coated along a substantial portion of their length, they also have a high electrical conductivity. The invention further includes electro-chemical cells, and processes for forming and utilizing the electrodes and cells.

10 Claims, 11 Drawing Sheets

PROCESS FOR FORMING ELECTRODES

This is a division of application Ser. No. 604,397 filed Apr. 26, 1984, now U.S. Pat. No. 4,680,100 which is a continuation of Ser. No. 507,604 filed June 24, 1983, now abandoned.

The present invention relates to electrodes having fibers which provide large surface areas, high bond strength between the core fibers and metallic coatings thereon, and efficient electrical connections; electro-chemical cells including such electrodes; and processes for forming and utilizing the electrodes and cells of the invention.

BACKGROUND OF THE INVENTION

Efficiency in electro-chemical processes, such as electrolysis, electroplating, electrowinning, electro-organic synthesis, and waste recovery, depends to a substantial extent upon the surface area of the electrode. Electrodes have been constructed with ridges or convolutions to increase the surface area. Sandblasting also has been used to roughen the electrode surface, and thus provide a larger surface area. These known techniques have been found to have limited effectiveness in increasing the surface area.

More recently carbon fibers for electrodes which provide large surface areas have been described in U.S. Pat. Nos. 4,046,663, 4,108,754 and 4,108,757. The electrodes comprise a plurality of carbon fibers arranged generally parallel to one another and clamped at one end to an electrical connection. Although these electrodes may have large surface areas, they provide relatively poor electrical connections. Specifically, a large number of carbon fibers invariably break as a tow of such fibers is clamped into an electrical connection. This breakage of fibers adversely affects the electrical effectiveness of the tow. Additionally, the mechanical connection of carbon fibers results in an undesirably high electrical resistance at the connection. Consequently, the theoretical efficiencies of the electrodes are not attainable because of the mechanically destructive and inefficient electrical connections.

The electrodes shown in U.S. Pat. Nos. 4,046,663 4,046,664, 4,108,754 and 4,108,757 also act as a wick, causing the electrolyte to be drawn up into the area of the terminal. When the electrolyte evaporates, a salt residue remains which affects the electrical connection. The salt deposits thermally shield the terminal causing heat buildup, increased resistance, and eventually terminal failure by bridging. Even if wicking and fiber damage could be controlled, there would be poor electrical connection to the fibers in the center of the bundle.

Several attempts have been made to place metallic coatings on the carbon fibers so that tows of the plated carbon fibers can be used more efficiently as electrodes in various electro-chemical processes. In most instances, the plating applied to these carbon fibers has been discontinuous, brittle, and expensive to apply. For example, U.S. Pat. No. 4,132,828 shows the vacuum deposition of nickel onto carbon fibers. The coating taught by this patent, however, is not continuously in contact with the carbon fibers and will easily break and fall off if the fiber is twisted.

Electroless nickel baths also have been employed to plate carbon fibers. However, this plating process is slow, expensive to carry out, and again results in inferior discontinuous coatings. Another undesirable coated fiber is shown in U.S. Pat. No. 3,622,283.

In view of the above, it is an object of the present invention to provide fiber containing electrodes having large surface areas, efficient electrical connections, and continuous metal coatings on fibers with high bond strengths therebetween.

It is a further object of the subject invention to provide plated and unplated fiber electrodes which can be bent, wrapped, woven or knitted into a variety of configurations for efficient use in electro-chemical cells.

It is still another object of the invention to provide electro-chemical cells and processes with electrically conductive fibers constructed into electrodes without the drawbacks of the prior art electrodes.

SUMMARY OF THE INVENTION

The electrode of the subject invention includes a plurality of fibers, wherein each fiber has at least one thin metallic coating firmly adherent thereto. The coating preferably is continuous and is bonded so well that if the metal coated fiber is bent, the coating may fracture, but will not peel off. The fibers for the electrodes of the invention can be semi-metallic, such as carbon and silicon carbide fibers, or non conductive, such as nylon, polyester and/or aramides fibers.

When the fibers are semi metallic, carbon or silicon carbide, the metal coating can be applied according to the method disclosed in my copending application Ser. No. 358,637, filed on Mar. 16, 1982, now abandoned. The fiber coating disclosed in application Ser. No. 358,637 is continuous and has enhanced bonding and flexibility characteristics. As a result, it is possible to form the fibers coated according to the process of application Ser. No. 358,637 into configurations which are useful for electrodes and which were considered unattainable with prior art metal coated carbon or silicon carbide fibers. It is to be understood, however, that although application Ser. No. 358,637 describes a preferred process for coating for carbon or silicon carbide fibers, the subject invention is not so limited.

In a preferred way of making the metal coated carbon or silicon carbide fibers, the following steps will be used:

(a) providing a continuous length of a plurality of the electrically conductive core fibers, (b) continuously immersing at least a portion of the length of said fibers in a solution capable of electrolytically depositing at least one metal, and (c) providing a quantity of electricity while applying an external voltage between the fibers and an electrode immersed in the solution, which voltage is in excess of what is normally required to cause metal deposition, whereby (i) the metal is reduced on the surface of the fibers, (ii) the metal nucleates substantially uniformly onto the surface of the fibers, and (iii) there is provided a substantially uniform, firmly adherent layer of metal on the core.

The fibers formed by the described method will have a metal to core bond strength sufficient to provide that if the fiber is bent, the coating may fracture, but it will not peel off. Moreover, in preferred fibers, the bond strength is more than sufficient to permit the fibers to be knotted without substantial, i.e., more than 5 percent by volume, separation and flaking of the coating.

When the fibers are non conductive, nylon, polyester and/or aramides, and the like, they are first rendered conductive by providing an extremely thin metallic interlayer as described in my copending application being filed simultaneously herewith Ser. No. 507,437 and then coated with a metallic layer as described in Ser. No. 358,637 both now abandoned.

Whether the core fibers are semi-metallic or non metallic, the electrode of the invention preferably is formed from fibers which are metal coated adjacent the connection of the electrode to a power source. The metal coating of the fibers enables the connection to the power source to be made by means such as soldering to create a continuous fiber/metal matrix adjacent to the electrical connection, thereby avoiding the mechanical connections, such as crimping, which damage fibers and reduce the effectiveness of the electrode. Additionally, the soldered connection and the resultant continuous fiber/metal matrix avoids wicking which had been prevalent with prior art mechanical connections, and which rapidly deteriorates the quality of the electrical connection. Also, the soldered connection and the resultant continuous fiber/metal matrix encapsulates all the fibers to the metal for low contact resistance even to the center of a mass of 100,000 fibers.

The subject electrode can be formed by metal plating only the portion of a fiber tow which will be adjacent the electrical connection. The electrode also can be formed from a fiber tow which is entirely metal coated, and which is subsequently stripped of part of the metal coating prior to use as an electrode. In most electrochemical applications, the electrode with plating only near the electrical connection, preferably would function as an anode.

The subject invention further includes an array of fibers with each fiber in the array being continuously coated with metal along their entire lengths. These coated fibers provide a large surface of high electrical conductivity. They are electrically connected to a power source by a means such as soldering to create an integral carbon/metal matrix adjacent the electrical connection. As explained above, this continuous matrix avoids damage to fibers and substantially prevents wicking. The electrode formed with plating along the entire length of each fiber, typically is used as a cathode.

As a result of the enhanced coating of the fibers, as described above in copending applications, Ser. Nos. 358,037 and 507,439, the disclosures of which are incorporated herein by reference, it is possible to form the subject fiber electrode into a variety of useful configurations which heretofore had been unavailable. Specifically, a metal coated fiber tow can be wound around a flow-through support with little or no possibility of having the metal coatings breaking from the fibers. Other plated electrode configurations include woven mats, which can be supported in a planar configuration or wrapped around a flow-through support, and knitted tubular configurations, which can be positioned around a cylindrical flow-through support.

As a result of the flexibility of the subject electrodes, several unique cell structures and processes are made available. For example, anodes and cathodes mounted around flow-through supports can be alternately arranged in one or more cells. The electrolyte then can be passed through the cells in such a manner as to ensure maximum contact with the carbon fibers. In one embodiment, each cell can contain an anode on a flow-through support and a cathode on a flow-through support. Each such cell could be separated by a non-conductive barrier, with each barrier having electrolyte passageways in the form of one or more holes. To achieve the desired flow pattern, the passageways in the barriers would be alternately located in a bottom corner or an opposed top corner. Holes disposed in this manner in the barriers help to achieve maximum contact of the electrolyte with the electrodes.

In another embodiment of the above described construction, each cell can include a plurality of the fiber containing anodes and cathodes wrapped around flow-through supports. A plurality of such multi-electrode cells can be arranged in series, with the connections between the cells constructed to ensure maximum contact of the electrolyte with the electrodes. As noted previously, this electrolyte flow pattern can be achieved by alternately locating holes in the barriers between cells in the top and bottom corners of the barriers.

Other electro-chemical cells of different configurations also are included in the present invention. For example, porous metal plates can be used as the cathodes and arranged alternately with the above described anodes. In still another embodiment a discretionary cell can be provided utilizing a small anode, such as a platinum wire, in conjunction with a large area metal plated fiber cathode to plate specific metals onto the cathode while leaving other metals in solution. To ensure optimum electrolyte contact with the electrodes of the above described discretionary cell, the metal plated fiber cathode can be formed into a cylindrical configuration with the cylinder being disposed concentrically about the anode. The cylindrical fiber cathode can be formed either by helically wrapping a fiber tow about a porous cylindrical form or by knitting a tubular structure from the metal plated fiber. Another cell of the invention which can be used for oxidation-reduction reactions in a bipolar cell, includes an alternate arrangement of anodes and cathodes in a cell containing both solutions, wherein one of the interconnected electrodes of the present invention is positioned in one solution while the other interconnected cell is positioned in the other solution.

In each of the described embodiments, the electrodes of the invention provide large surface areas, efficient electrical connections and high bond strength between the core fibers and the metal coatings thereon.

BRIEF DESCRIPTION OF THE DRAWINGS

The following is a detailed description together with accompanying drawings of illustrative embodiments of the invention. It is to be understood that the invention is capable of modification and variation apparent to those skilled in the art within the spirit and scope of the invention.

DETAILED DESCRIPTION OF THE PREFERRED EMBODIMENT

Figure 1:
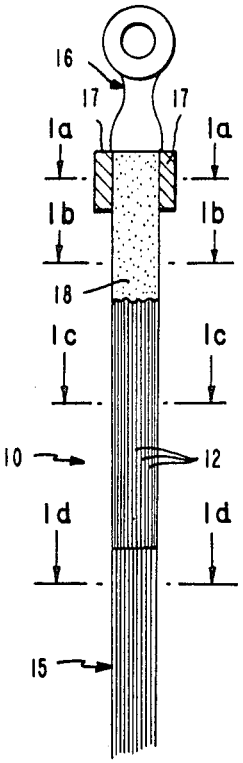
FIG. 1 is an elevational view, partly in section, of an electrode of the present invention including a tow of partially plated fibers and an integral fiber/metal matrix at its terminal.

The electrode of the subject invention is indicated generally by the numeral 10 in FIGS. 1, 1*a*, 1*b*, 1*c*, 1*d* and 2. The electrode 10 is formed from a plurality of fibers 12, each including a central, preferably carbon, fiber 13, e.g., about 7 to 11 microns, and a thin concentric continuous layer 14 of nickel or other plated metal, e.g., about 0.5 microns. The plated fibers 12 are formed into a tow 15, which is a generally parallel array of numerous plated fibers 12, e.g., about 40,000 to 50,000 fibers, wherein the tow typically has a diameter of about 0.125 inch. A tow 15 of the desired length is placed in an electrical connector 16 such that the clamping arms 17 of the electrical connector 16 are engaged about one end of the tow 15. More particularly the arms 17 of the electrical connector 16 are engaged about the tow 15 with sufficient force to loosely retain the tow 15, but yet ensuring that the plated fibers 12 are not damaged. This force exerted by the clamping arms 17 on the tow 15 is substantially less than the force that normally would be utilized if this mechanical connection were to be relied upon for the conduction of the electricity.

Once the tow 15 has been engaged by the electrical connector 16, the combination of the connector 16 and tow 15 is dipped in a bath of molten metal, such as solder of about 60% tin and about 40% lead. Solder 18 wicks into the area between adjacent plated fibers 12 and the area between the electrical connector 16 and the plated fibers 12 to form what is effectively a carbon/metal matrix at the end of the electrode 10 thereby defining an efficient electrically conductive connection between the tow 15 and the connector 16. The desired wicking of the plated fibers 12 can be accomplished in a matter of seconds, typically in about 10 seconds.

Figure 1A:
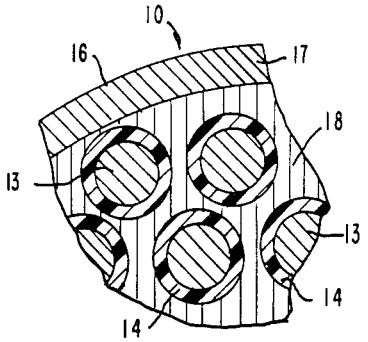
FIG. 1*a* is an enlarged cross-sectional view of FIG. 1 taken along lines 1*a*—1*a* thereof.
Figure 1B:
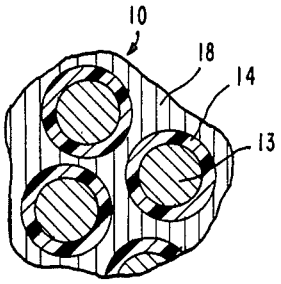
FIG. 1*b* is an enlarged cross-sectional view of FIG. 1 taken along lines 1*b*—1*b* thereof.
Figure 1C:
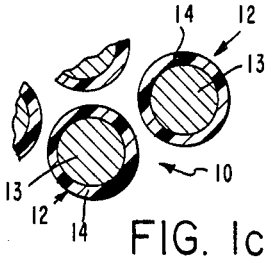
FIG. 1*c* is an enlarged cross-sectional view of FIG. 1 taken along lines 1*c*—1*c* thereof.
Figure 1D:
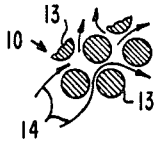
FIG. 1*d* is an enlarged cross-sectional view of FIG. 1 taken along lines 1*d*—1*d* thereof.

The metal plating 14 on the portion of each fiber 13 away from the connector 16 then is stripped off, for example, by dipping in a bath of nitric acid. More particularly, the plating 14 is stripped so as to leave a short section of plating 14 extending away from the solder 18. Preferably the plating 14 extends between one-half inch and two inches. from the solder 18, as indicated by dimension "x" in FIG. 2. Thus, as illustrated in FIG. 1*a*, the uppermost portion of electrode 10 defines an integral carbon/metal matrix comprising the carbon fibers 13, the plating 14, the solder 18 and the arms 17 of connector 16. Slightly away from connector 16, as shown in FIG. 1*b*, the integral carbon/metal matrix comprises the carbon fiber 13, the plating 14 and the solder 18. Still further away from the connector 16, as shown in FIG. 1*c*, the electrode 10 includes carbon fibers 13 and plating 14 but no solder 18. This plating 14 without the solder provides a step resistance for current averaging from terminal 16 to stripped fiber 13. In so doing a current gradient is provided to prevent a surge area which would more rapidly be attacked by any electrolyte in contact therewith. Finally, as shown in FIG. 1*d*, in the remainder of the electrode 10 the fibers 13 are loosely arranged in tow 15 with no plating, and the electrolyte, indicated generally by arrows 19, can flow freely between and achieve maximum contact with fibers 13. These carbon fibers are graphite and generally free of amorphous carbon.

Figure 3:
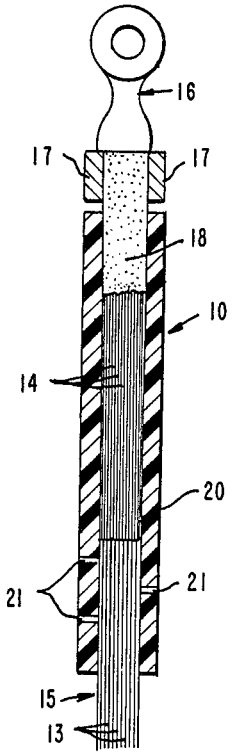
FIG. 3 is an elevational view, partly in section, of the electrode of FIG. 1 used in conjunction with a protective tube.

Turning to FIG. 3, the electrode 10 is used in conjunction with a non-conducting protective tube 20 formed from plastic or other inert material. The tube 20 is loosely fit over the electrode 10 and extends generally from the connector 16 to a point along electrode 10 which will be disposed several inches below the surface of the electrolyte with which the electrode 10 is used. The protective tube 20 reflects the fact that the most aggressive damaging electrolytic reactions take place within the area immediately below the surface of the electrolyte. The protective tube 20 thus minimizes the damaging effects in this critical area of the electrolyte. To further minimize the effects of the transition between the electrolyte and the electrode 10, the protective tube 20 is provided with a plurality of small holes 21 at the end of the protective tube 20 most distant from the electrical connector 16 to effectively create a transition zone of current gradient to minimize an area of current surge and electrolyte attack.

Figure 4:
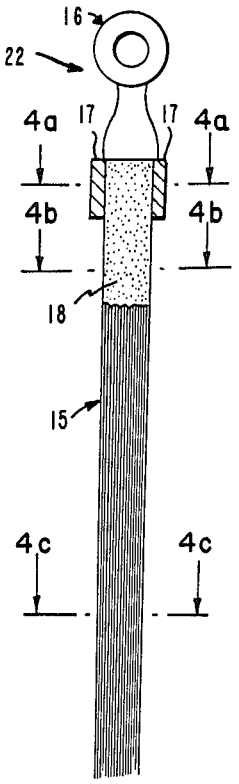
FIG. 4 is an elevational view, partly in section, of another electrode of the subject invention including a tow of fully plated fibers.
Figure 4A:
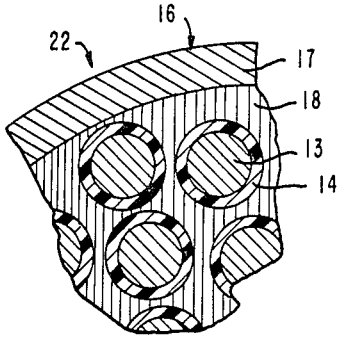
FIG. 4*a* is an enlarged cross-sectional view of FIG. 4 taken along lines 4*a*—4*a* thereof.
Figure 4B:
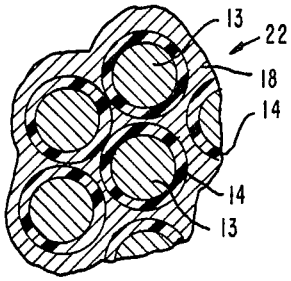
FIG. 4*b* is an enlarged cross-sectional view of FIG. 4 taken along lines 4*b*—4*b* thereof.
Figure 4C:
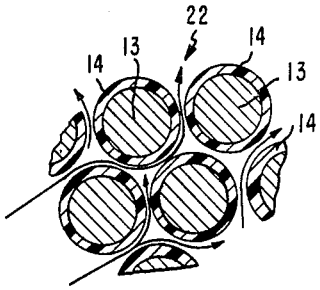
FIG. 4*c* is an enlarged cross-sectional view of FIG. 4 taken along lines 4*c*—4*c* thereof.

Another electrode 22 of the invention is illustrated in FIGS. 4, 4*a*, 4*b*, 4*c* and 5. The electrode 22 is similar in construction to the above described electrode 10 except that electrode 22 includes plating 14 disposed continuously along the entire length of each fiber 13. Thus, as illustrated in FIG. 4*a* the portion of electrode 22 adjacent connector 16 defines an integral carbon/metal matrix comprising carbon fibers 13, metal plating 14, solder 18 and arms 17 of connector 16. At a location on electrode 22 spaced sightly from connector 16, the integral carbon/metal matrix comprises carbon fibers 13, metal plating 14 and solder 18 as shown in FIG. 4*b*. Further away from connector 16 and extending to the opposite end of electrode 22, the fibers 13 each include metal plating 14, but, as indicated by arrows 19, the electrolyte may freely flow through the electrode 22. These metal plated fibers have a high electrical conductivity.

Figure 5:
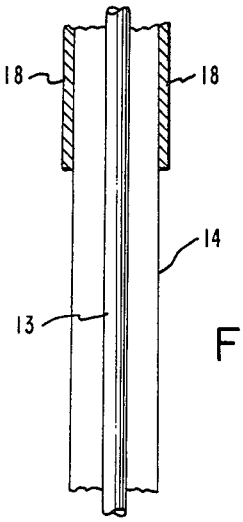
FIG. 5 is an enlarged elevational view, partly in section, of a single fiber of the electrode shown in FIG. 4.
Figure 6:
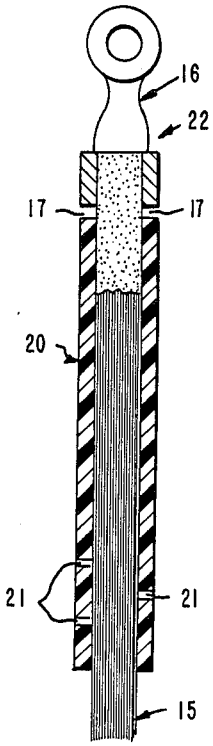
FIG. 6 is an elevational view, partly in section, of the electrode of FIG. 4 used in conjunction with a protective tube.

FIG. 6 illustrates electrode 22 used in conjunction with protective tube 20, which, as noted above, minimizes the damaging effects of the electrolyte at the boundary between the electrolyte and the ambient surroundings. In most electro-chemical applications the electrodes shown in FIGS. 4–6 are used as cathodes.

Figure 2:
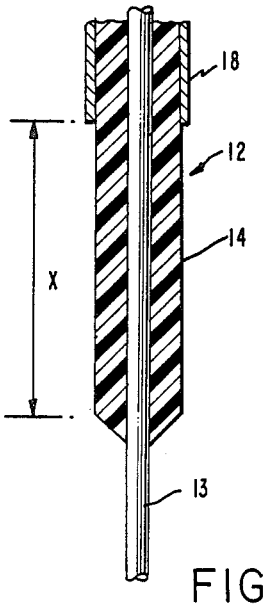
FIG. 2 is an enlarged elevational view, partly in section, of a single fiber of the electrode shown in FIG. 1.
Figure 7:
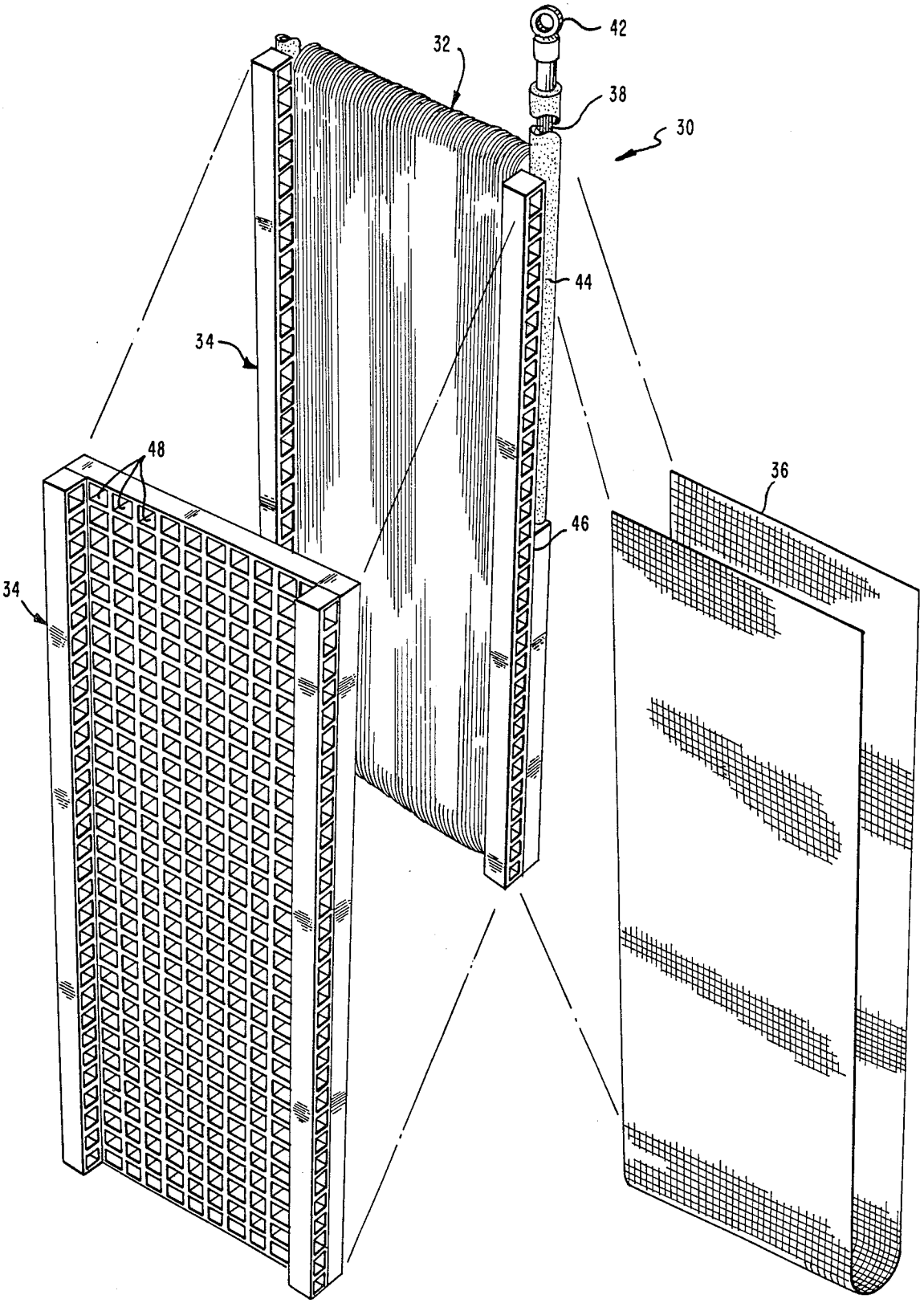
FIG. 7 is an exploded perspective view of another embodiment of the electrode of the subject invention wherein the tow of fibers are wrapped about a flow support.
Figure 8:
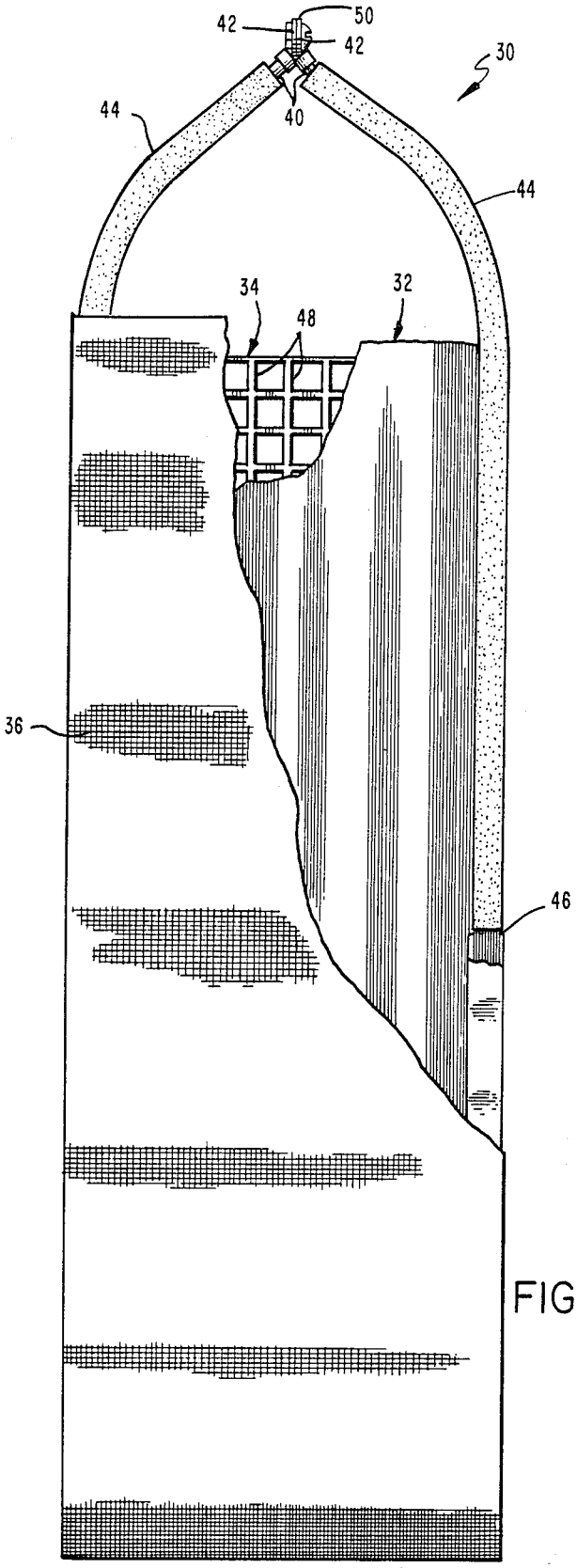
FIG. 8 is an elevational view, partly in section, of the electrode shown in FIG. 7.
Figure 9:
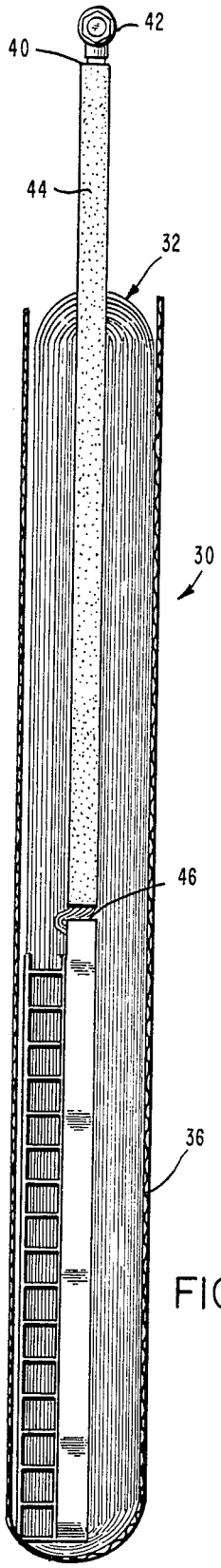
FIG. 9 is a side view, partly in section, of the electrode shown in FIG. 7.

FIGS. 7–9 show a generally planar electrode 30 incorporating the subject invention. The electrode 30 is formed from an elongated tow 32 which is wrapped around a generally rectangular flow-through inert support 34 and which is held in position on the support 34 by an inert screen 36. The tow 32 can be either stripped of most plating as shown in FIGS. 1–3 or can be entirely plated as shown in FIGS. 4–6. All electrodes 30, whether used as anodes or cathodes, include a metal plated area 38. This metal plated area 38 enables the application of solder 40 to attach the electrical connector 42 to the tow 32 and thus forming an integral carbon/metal matrix. As explained above, the metal plated area 38 preferably extends beyond the limits of the soldered area 40, and on certain electrodes would extend throughout the entire length of the tow 32. The electrode 30 further includes a protective tube 44 which typically extends from a location above the interface between the air and the electrolyte to a location preferably 3 or 4 inches into the electrolyte. Although the protective tubing 44 could terminate above the flow-through support 34, it preferably extends into an area adjacent the flow-through support 34 to facilitate mounting of the tow 32 on support 34. As illustrated most clearly in FIG. 7, the flow-through support 34 has numerous apertures 48 and can include an elongated cut out portion or groove 46 into which the tube 44 is placed. The tow 32 then can be threaded through an aperture in the flow-through support 34, and wrapped around the support 34 in a contiguous manner. Although a single tow 32 terminated at each end is shown in FIG. 8, multiple tows and terminations can be used in the practice of the invention. The tow 32 is held in position on the support 34, and is protected from damage by the screen 36, which is folded around the combined flow-through support 34 and tow 32. The screen 36, which can be made of nylon or fiberglass, also prevents stray fibers from one electrode from contacting another electrode.

When the electrode 30 is used as a cathode, the entire tow 32 typically is maintained in its plated condition. With the preferred plating, as described above, the plating will remain intact on the fibers of tow 32 despite the many sharp bends which are made in tow 32 during the formation of electrode 30.

When the electrode 30 is employed as an anode, the plating typically is removed from the tow 32 for all areas of the tow 32 except the areas near the solder connection 40 of tow 32 to the electrical connector 42. This removal of the plating from tow 32 can be carried out either before or after the mounting of tow 32 on the flow-through support 34.

In the illustrative embodiments of FIGS. 1–9 the fibers 12, which form the core of the electrodes 10 or 30, are carbon. In addition, the fibers 12 can be formed from other semi metallic fibers, such as silicon, carbon, or non conductive fibers, such as nylons, polyesters and/or aramides and the like, which are rendered electrically conductive by a thin intermetallic layer of silver, copper, nickel and the like.

The metal coating 14 can be formed from a wide variety of metals including nickel, copper, silver, lead, zinc, the platinum group and other metals depending upon the application. Also, the metal coating can be multi-layered, e.g., an inner layer of nickel and an outer layer of silver.

With respect to the matrix, the term solder as used herein, includes alloys, such as tin and lead or copper and silver, as well as pure metals, e.g., copper. The solder matrix creates an electrical bridge between the walls of the terminal and each and every fiber 12.

The length of the tow of the fibers 12 will depend upon the width and length required for the electrode 10 or 30 and can be wrapped as shown in FIGS. 7–9 or woven or knitted. Illustratively, tows from a few inches to over 40 feet in length have been satisfactorily used in the practice of the invention.

One of the features of the present invention is the large surface area made possible by the electrodes in a small volume of solution which effects a low current density while yielding a high total current for the Farraday equivalents. Illustratively, a fiber of 7 microns which results in a coated fiber of 8 microns after plating in a tow of 40,000 (40K) fibers equals 40 square inches of area per inch of length of tow.

Furthermore, the resistance of the electro-plated fibers is so low that the potential of the tow is substantially uniform even at a substantial distance from the terminals.

The electrodes of the present invention can be used in the removal and recovery of soluble metals in dilute solutions, such as process streams from plating, hydrometallurgy of mining, waste streams from mining, as well as wherever metals are present in dilute solutions, such as in photographic and catalytic processes. As has been described, the electrodes of the present invention have large effective areas. As a result, effective winning currents and discretionary voltages can be achieved for the selective recovery of metals and removal of impurities. Moreover, the electrodes can be used in bipolar cell systems for effective oxidation and reduction in separated chambers for solute recovery and electro-organic chemistry.

In the ensuing embodiments, electro-chemical cells and processes are described utilizing the electrodes of the present invention.

A typical application of the electrodes 30 described above is shown in FIG. 10 which illustrates a tank 52 used for an electro-chemical process such as the removal or recovery of metals from an electrolyte 54. The electrodes which are used as anodes are identified as 30A, while the electrodes used as cathodes are identified as 30C. Anodes 30A and cathodes 30C are arranged alternately in the tank 52 with flow-through spacer panels 56 disposed intermediate adjacent anodes 30A and cathodes 30C. The tank 52 includes a plurality of cells, with each cell including one anode 30A, one flow-through spacer panel 56 and one cathode 30C.

Figure 10:
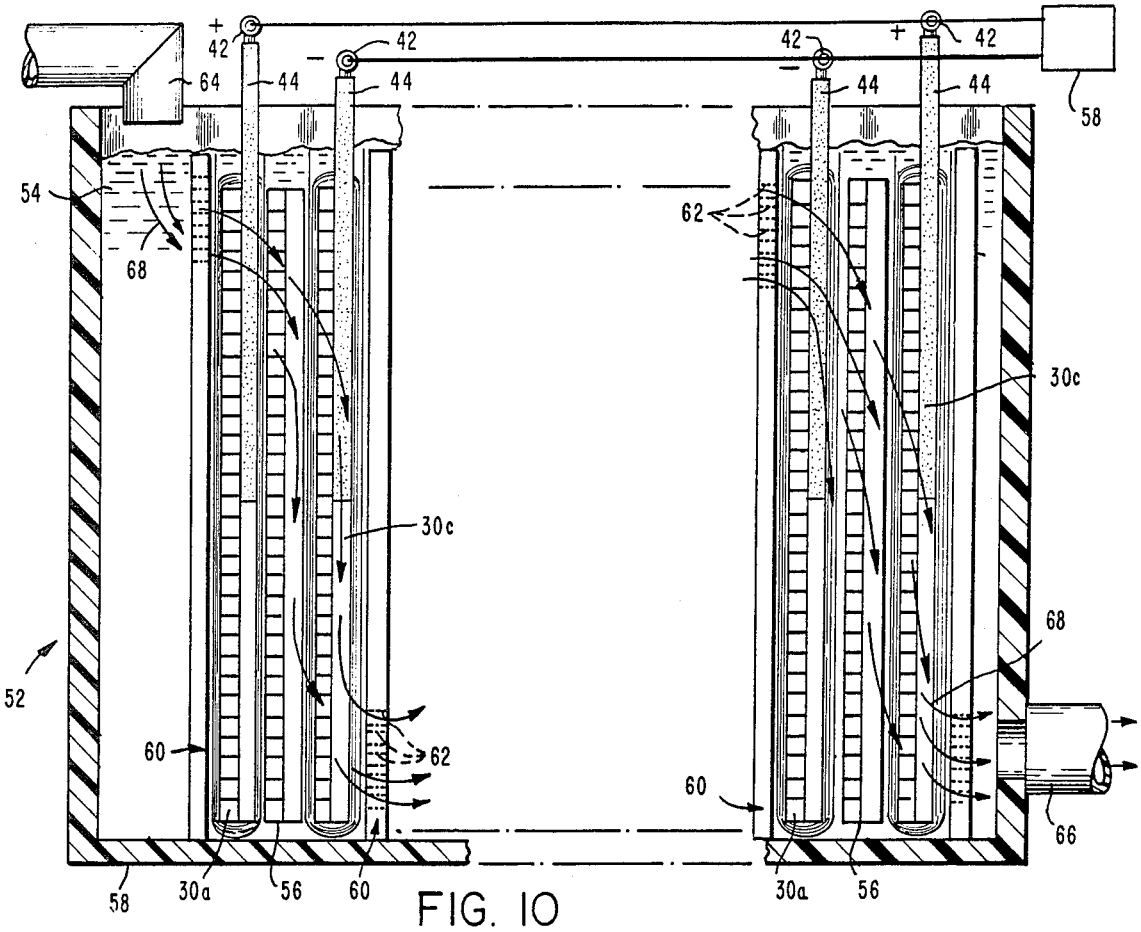
FIG. 10 is a side view, partly in section, of an electro-chemical cell of the subject invention including the electrode of FIGS. 7–9.

The anodes 30A and cathodes 30C are electrically connected to a power source 58 by standard circuitry as shown in FIG. 10. The voltage differential provided by the power source is a function of the current/voltage relationship for the particular electrolytic solutions. The preferred voltage would correspond to the appropriate "knee" in the current/voltage curve for the particular metal which is to be removed or recovered.

Figure 11:
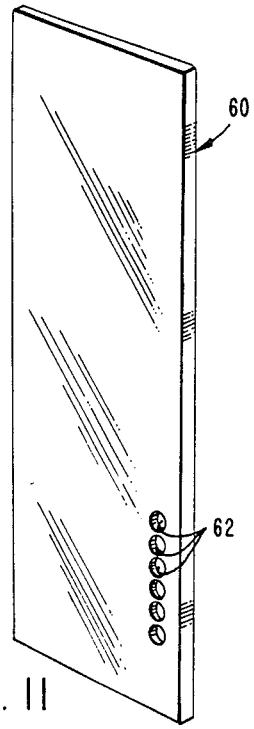
FIG. 11 is a perspective view of the divider panels used in the electro-chemical cell of FIG. 10.
Figure 12:
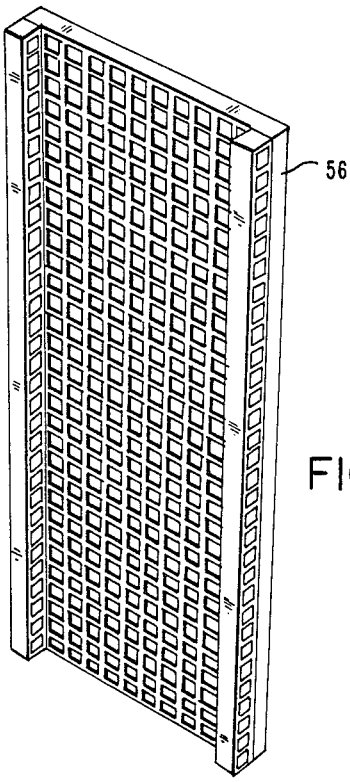
FIG. 12 is a perspective view of the flow-through spacer positioned between the electrodes of FIG. 10.

Each cell in tank 52 is defined by a pair of divider panels 60 as shown in FIG. 11. Each panel 60 is formed from an inert see-through material such as polymethyl methacrylate and includes a plurality of holes 62 adjacent one corner of panel 60 and illustratively arranged in a vertical row. Preferably the total area of holes 62 is about 50% greater than the area of outflow conduit 66. The holes 62 can be about 0.625 inch in diameter and are spaced approximately 0.5 inch apart. The holes 62 are provided to enable the flow of electrolyte 54 from one cell to the next cell in the tank 52. More particularly, the panels 60 are rotated 180° within the plane of the panel 60. As a result, one panel 60 will have holes 62 in a bottom corner, while the adjacent panel 60 will have holes 62 disposed in the opposite top corner.

In operation the electrolyte 54 is directed into the tank 52 through inflow conduit 64 which is located adjacent the upper edge of the tank 52. The electrolyte 54 initially enters an accumulation area 55 prior to passing through the holes 62 in the first divider panel 60. This construction ensures the desired flow pattern of electrolyte 54 into and through the first cell. The accumulation area 55 also functions as a surge averager and collects any sediment that may be in the electrolyte 54. The electrolyte 54 is ultimately urged out of tank 52 through outflow conduit 66. The arrangement of holes 62 in panels 60 throughout the tank 52 causes the electrolyte 54 to alternately flow upwardly and downwardly and across from one cell to the next. This general flow pattern of the electrolyte 54 through tank 52 which is illustrated graphically by the arrows 68 causes the electrolyte to cascade in length and width relative to the tank 52 to maximize residence time of the electrolyte in the tank 52 and contact time with the electrodes 30 all to optimize recovery or removal of the metal from the solution. Thus, the construction of the anodes 30A and cathodes 30C as described above, provides an extremely large surface area, while the construction of the tank assures maximum contact of the electrolyte 54 with the anodes 30A and cathodes 30C.

The metal to be recovered or removed is plated onto the cathode 30C. Periodically, therefore, it is necessary to remove the cathodes 30C from the cell to win the metal. This winning of recovered metal from the cathode 30C typically can be accomplished by digestion, pyrometallurgy or by making the cathode anodic in a concentration cell.

Figure 13:
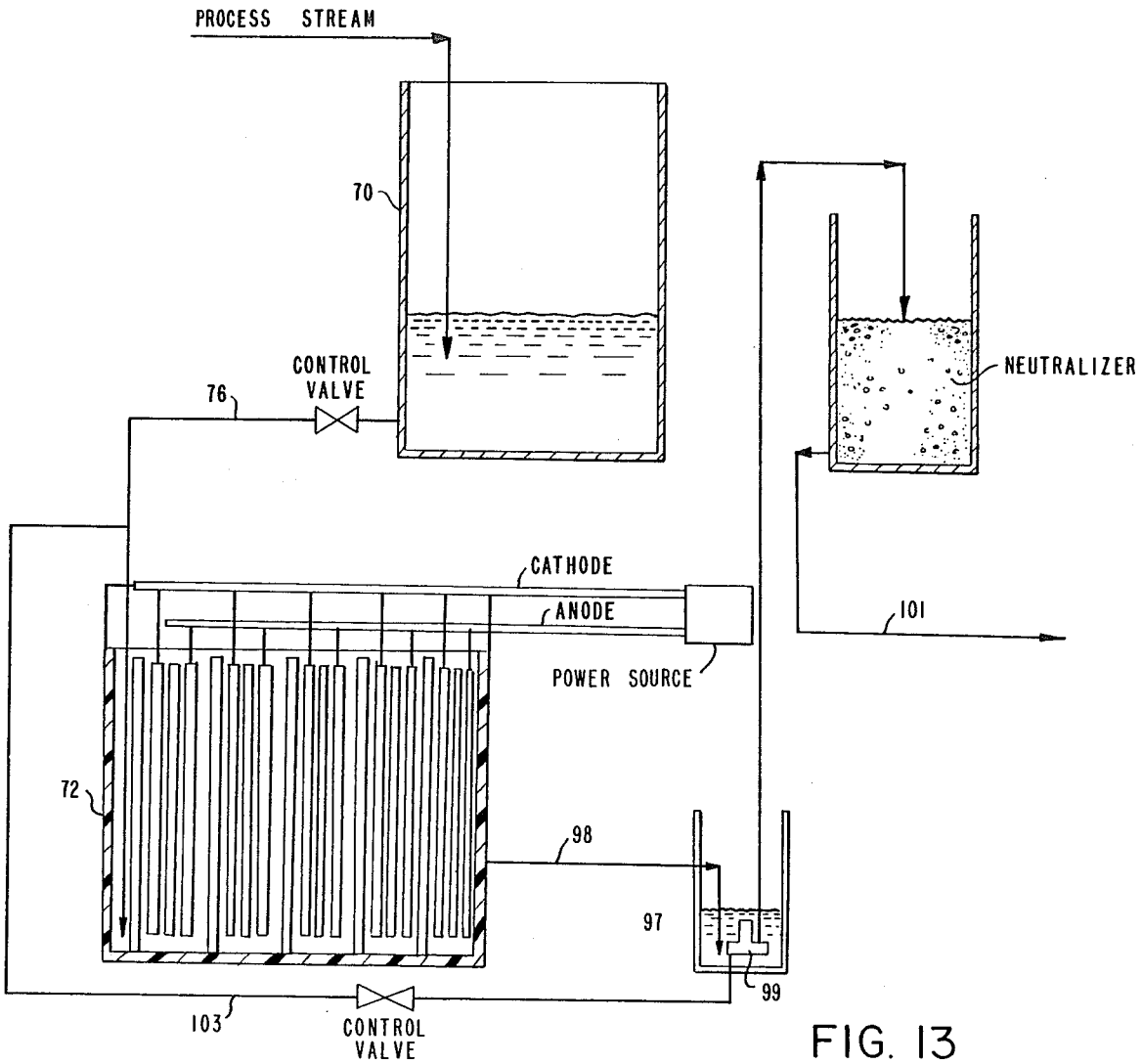
FIG. 13 is a schematic diagram of an electro-chemical system including an electro-chemical cell of the subject invention.
Figure 14:
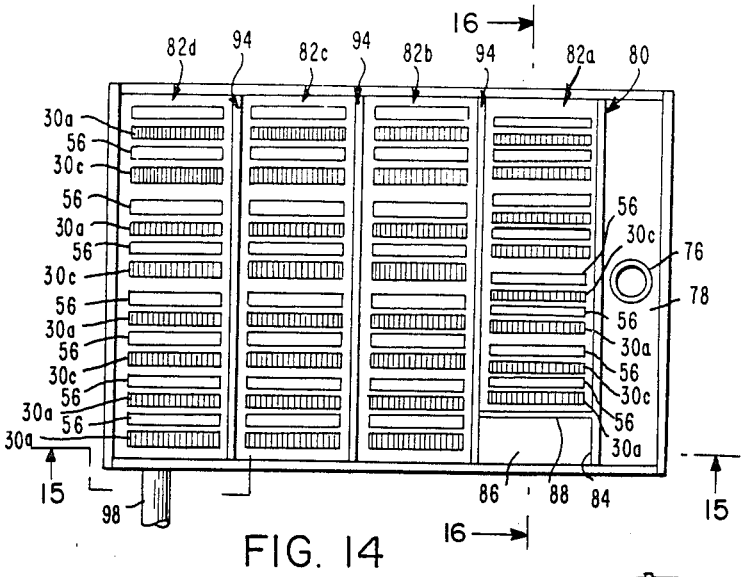
FIG. 14 is a plan view of the electro-chemical cell shown in FIG. 13.
Figure 16:
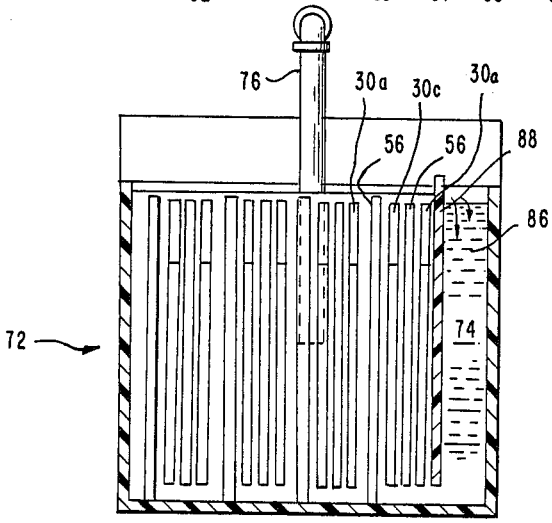
FIG. 16 is a cross-sectional view of FIG. 14 taken along lines 16—16 thereof.

The electrochemical and structural principles described above can be incorporated into a system, as shown in FIG. 13, for treatment of a process stream which incorporates an electrochemical cell shown in detail in FIGS. 14 and 16. In this system, the process stream is pumped into storage tank 70, and then is directed into the multi-cell tank 72. The process stream is denuded of metal in tank 72 and discharged through conduit 98 to an accumulator 97. The effluent in accumulator 97 is pumped by pump 99 to the neutralizer tank 100 containing limestone, where it is neutralized and then discharged as waste via conduit 101.

Figure 15:
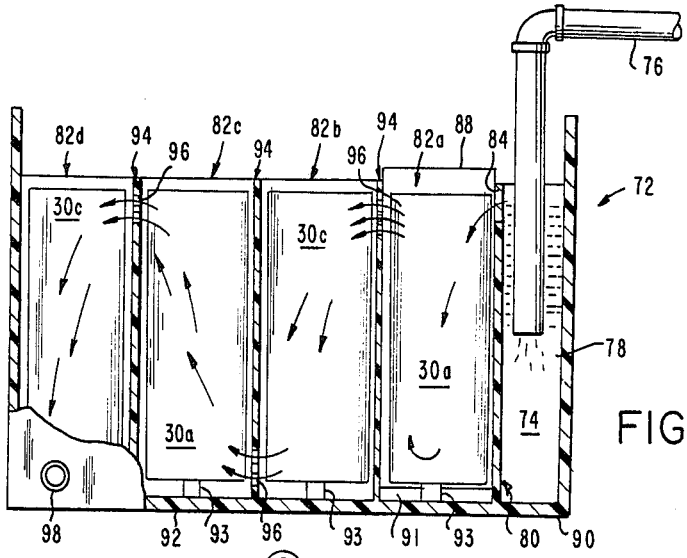
FIG. 15 is a side sectional view of FIG. 14 taken along lines 15—15 thereof.

Referring to FIGS. 14–16, the process stream containing a dilute acid solution of a metal, e.g., nickel, tin, lead, copper, etc., is directed through the inflow conduit 76 into an accumulator 78. The illustrated tank 72 is rectangular and a divider panel 80 extends across its width at one end thereof to form a chamber which serves as the accumulator 78. The divider panel 80 between the accumulator 78 and the first cell 82A of the tank 72 includes a channel 84 which allows the process stream 74 to flow into the upper portion of the surge control area 86. More particularly, the surge control area 86 is defined by a surge panel 88 which extends thereacross at one end thereof above the level of process stream 74 in the first cell 82A to a point spaced from the bottom wall 90 of the bath 72. This provides a bottom channel 91 through which the process stream flows into the first cell 82A. The first cell 82A is provided with an alternating and repetitive array comprising an anode 30A, a flow-through spacer panel 56, a cathode 30C and a second flow-through spacer panel 56. This arrangement repeats itself such that each cell 82A through 82D includes a plurality of alternating anodes 30A and cathodes 30C. As shown in FIG. 15, the anodes 30A and cathodes 30C are spaced from the bottom wall 90 and supported on members 93 to allow for the collection of sediment. As shown in FIG. 13, the anodes 30A and cathodes 30C are connected to a variable power source by standard circuitry, such as common bus bars. For clarity, the electrical connectors are not shown in FIGS. 14–16. As already described, the voltage for the operation of the system is selected to optimize the recovery or removal of metals from the electrolyte 54.

The cells 82A through 82D extend across the tank 72 parallel to the accumulator 78 and are separated from one another by divider panels 94. Each divider panel includes one or more holes 96 located in one corner of the divider panel 94. As described above, the divider panels 94 are alternately rotated 180° within their plane such that the holes 96 are alternately in opposed top and bottom corners. Thus, the divider panel 94 between cells 82A and 82B has holes 96 located in the corner most distant from the bottom wall 92 and the surge panel 88. It follows that the divider panel 94 between cells 82B and 82C is disposed in the corner nearest the bottom wall 92 and the surge panel 88. This particular construction ensures an end-to-end flow pattern of the process stream within each cell 82A through 82D along with either a top-to-bottom flow pattern or a bottom-to-top flow pattern. As previously described, this flow pattern optimizes residence time of the process stream in the tank 72 while minimizing channeling. The process stream 74 is ultimately removed from the bath 72 through the outflow conduit 98 which is located near the bottom wall 92 of the bath 72.

The electrochemical cells and processes shown in FIGS. 10–12 and 13–16 are suited for the removal and recovery of metals, including semiprecious and precious metals, from process or waste streams to less than about 1.0 ppm. For example, the system of FIGS. 13–16 can be used to remove in a single pass about 50% of the nickel in a process stream containing 30 ppm nickel flowing at the rate of 5 gallons per minute in a 50 gallon multi cell tank 72. To remove additional nickel the process can be repeated until the nickel is reduced to a satisfactory level for discharge. This can be done by recycling the process stream from the conduit 98 to the conduit 76 via conduit 103 before the stream is ultimately fed to the neutralizer.

The described cells also can be used to disassociate the solution to render soluble salts, e.g., municipal waste, insoluble for filtration from the effluent.

Figure 17:
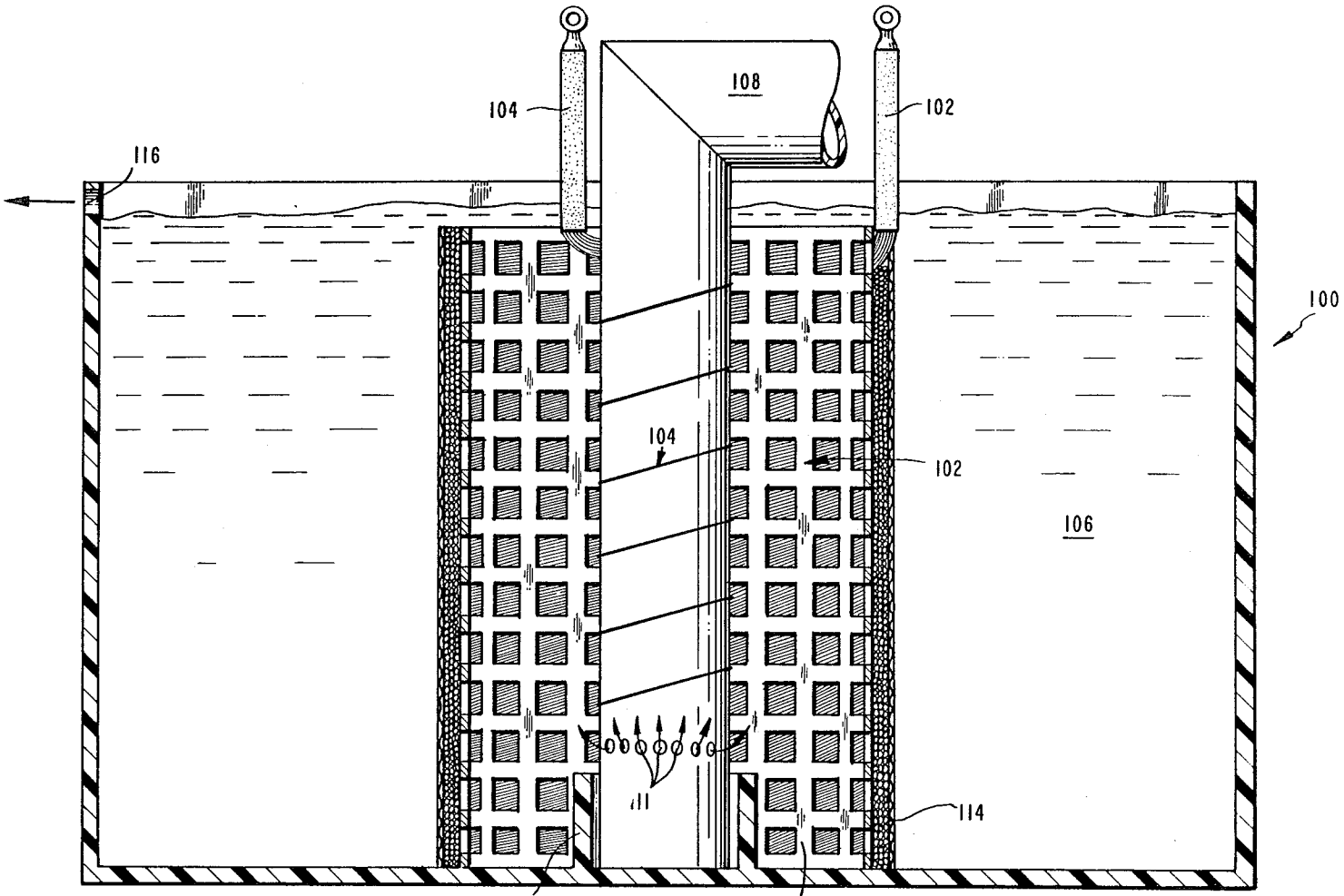
FIG. 17 is an elevational view, partly in section, of a discretionary electro-chemical cell of the subject invention.
Figure 18:
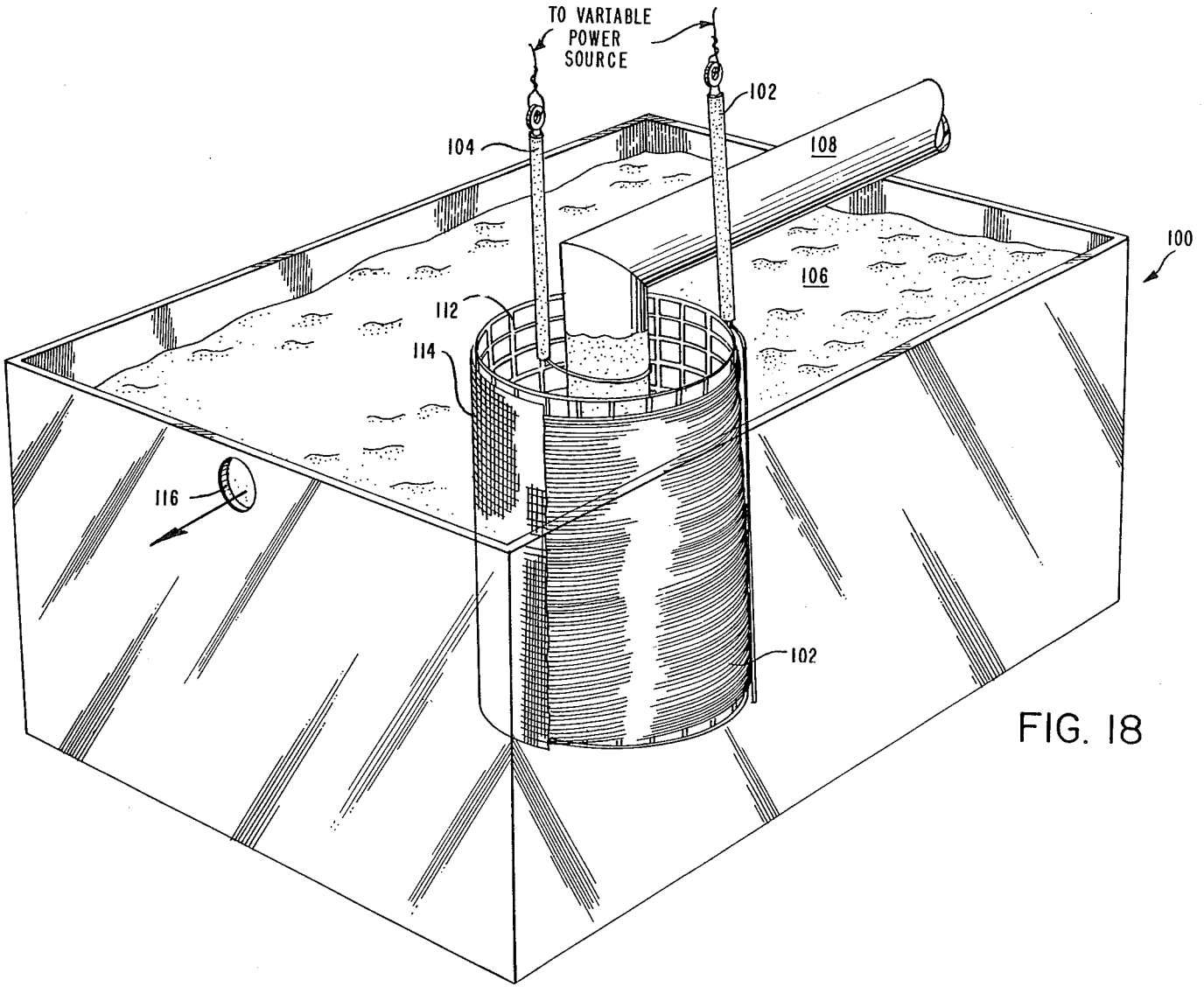
FIG. 18 is a perspective view of the cell shown in FIG. 17.

Furthermore, the subject electrodes can be utilized in a discretionary cell, as shown in FIGS. 17 and 18 where the voltage is varied to a particular precise selected level for causing a desired metal to deposit on the cathode while metals higher in the electromotive series remain in solution. To accomplish this type of discretionary plating it is necessary to employ a cathode having a large surface area. This objective is achieved within a small space and with a small amount of electrolyte by the discretionary cell 100 shown in FIGS. 17 and 18 which employs a carbon fiber cathode 102 with a thin single wire anode 104 such as platinum. The electrolyte 106 is directed into the discretionary cell 100 through an inflow conduit 108 which is located approximately centrally within the discretionary cell 100. The inflow conduit 108 is mounted in a deflector socket 110 and includes a plurality of holes 111 which cause the electrolyte 106 to be dispersed uniformly about the cell 100. The single wire anode 104 is wrapped helically around the inflow conduit 108. The cathode 102 then is disposed concentrically around, but spaced from, the anode 104. As a result of this construction, the electrolyte 106 flowing out of the inflow conduit 108 is urged past the anode 104 and through the cathode 102 to carry out the desired plating of the metals on the cathode 102.

The cathode 102 used in the discretionary cell 100 is a nickel plated carbon fiber electrode. The concentric mounting of the cathode 102 about the anode 104 is achieved by uniformly winding the cathode 102 about a generally cylindrical plastic flow-through support or grid 112. The flow-through support 112 can be formed, for example, from a sturdy but flexible plastic screen bent and secured into a cylindrical configuration. The cathode 102 is secured on the support 112 by a porous outer screen 114. The flow-through characteristics of the support 112 and the screen 114 readily permits the flow of electrolyte 106 through the cathode 102 and into contact with the many nickel plated carbon fibers which comprise the cathode 102.

Although the cathode 102 is shown as being uniformly wound about the grid 112, it is understood that the cathode 102 could be knitted into a cylindrical configuration or woven into a mat which in turn would be wrapped around the grid 112 or other flow through structural support. Outflow conduit 116 also is provided to remove the electrolyte 106 from the discretionary cell 100. Typically, the discretionary cell 100 defines a closed system with outlet 116 and inflow conduit 108 being in communication with a common source of electrolytic solution from which metal will be removed. The discretionary cell 100 can be constructed to any size. For example, cell 100 can be a small unit mounted over a larger tank containing the electrolytic solution. In a typical application 40K nickel plated tow cathode 102 was formed into a cylinder, as shown in FIG. 17, having a diameter of about four inches and a length of about 12 inches. This cathode 102 provides a surface area of about 100 square feet, and can be mounted in a discretionary cell with a volume of less than one gallon. Alternatively much larger tanks can be constructed. As described above, after a suitable amount of the metal in the electrolyte 106 has been deposited on the cathode 102, the process is stopped temporarily to remove and/or replace the cathode 102 so that the metal deposited thereon can be suitably removed where the metal is a contaminant or recovered where the metal has value.

Figure 19:
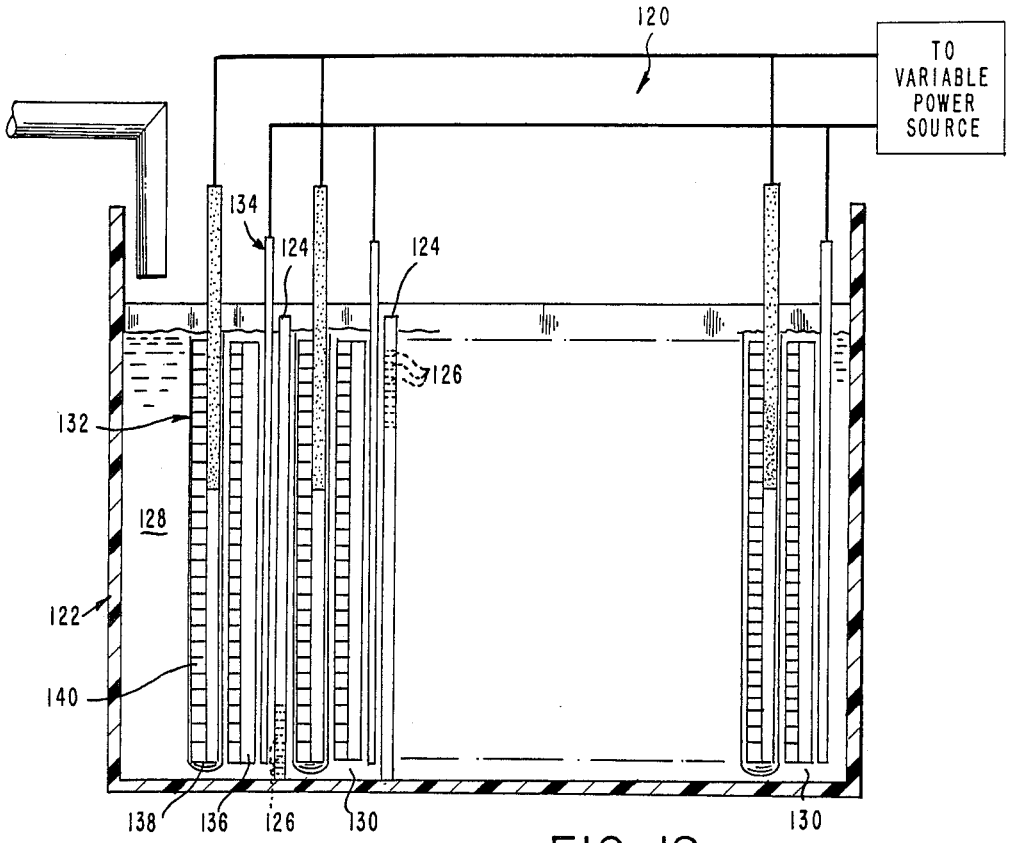
FIG. 19 is a side elevational view, partly in section, of an electro-chemical cell of the invention, including a porous plate electrode.
Figure 20:
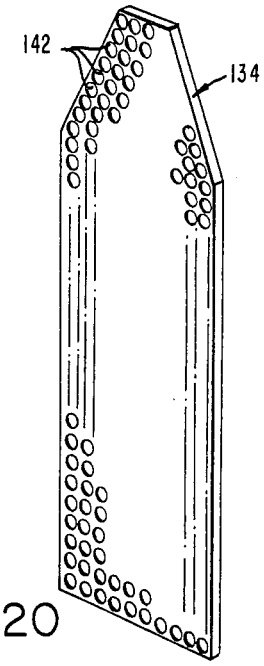
FIG. 20 is a perspective view of the porous plate electrode of the cell of FIG. 19.

Turning to FIGS. 19 and 20, this electro-chemical cell includes a tank 122 which is substantially identical to the tank 52 shown in FIG. 10. The tank 122 includes a plurality of dividers 124 each of which includes a plurality of apertures 126 through which the electrolyte 128 can pass. As described, the holes 126 are disposed adjacent a corner of the panel 124, and the panels 124 are alternately rotated 180° through their plane to create the desired up-and-down and side-to-side flow pattern of the electrolyte 128 through and across the tank 122.

As previously described, the panels 124 separate the various cells from one another, wherein cell 130 includes an anode 132 and a cathode 134 separated by a flow-through spacer panel 136. The anode 132 includes a carbon fiber tow 138 wrapped around a flow-through support 140. More particularly, the carbon fiber tow 138 of each anode 132 is formed from a plurality of carbon fibers each of which is metal plated adjacent the electrical connection, but is unplated or stripped of plating more distant from the electrical connection. Thus, each anode 132 is of substantially the same configuration as the anode 30A described above.

As shown in FIG. 20, the cathodes 134 are flow-through or porous metallic plates which include a plurality of apertures 142. In this embodiment the plate 134 is stainless steel. The flow-through spacer panels 136 which are disposed intermediate each anode 132 and cathode 134 are substantially identical to the already described flow-through spacer panels 56.

Illustratively, the cell of this embodiment of the invention can be used to remove and recover cyanide and other alkaline electrolytes which contain metals, such as silver, copper, zinc, cadium and tin.

Figure 21:
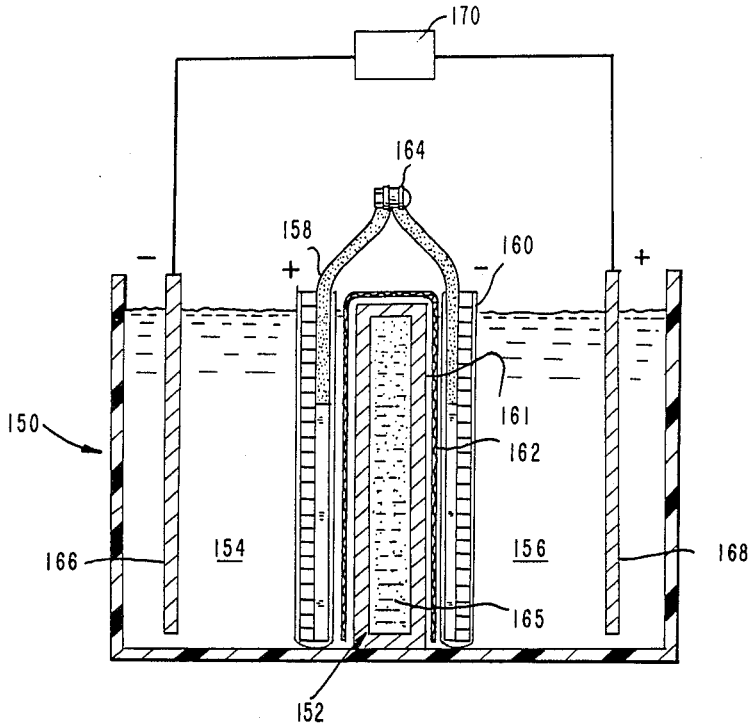
FIG. 21 is a side elevational view, partly in section, of a bipolar electro-chemical cell of the subject invention.
Figure 22:
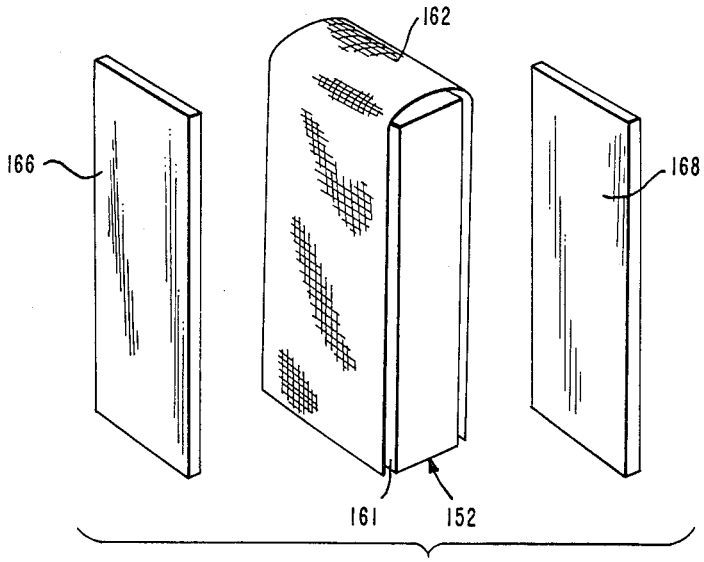
FIG. 22 is a perspective view of the divider and the active electrodes of the cell of FIG. 21.

Another embodiment of the invention which is particularly useful in electro-organic chemistry and synthesis and in the treatment of organic residues is illustrated in FIGS. 21 and 22. Referring to FIG. 21, the cell includes a tank 150 divided by a porous membrane 152 into two chambers for two distinct electrolyte solutions 154 and 156. The cell also includes an anode 158 and a cathode 160 which are substantially identical to the already described anodes and cathodes 30A and 30C. The anode 158 and cathode 160 are passive electrodes which are electrically connected to one another at point 164, but are not electrically connected to an outside power source, thus becoming bipolar. The anode 158 and cathode 160 preferably are separated from one another by the porous membrane 152 so that the anode 160 is in the chamber containing the electrolyte 154 and the cathode is in the chamber containing the electrolyte 156. The membrane 152 includes a hollow support 161 about which is secured a porous member 168, such as canvas. As shown, the membrane 152 is filled with solution 165, which can be neutral. The active electrodes for the cell are the plate cathode 166 in the electrolyte 154 and the plate anode 168 in the electrolyte 156. As stated, the electrolyte solutions 154 and 156 are distinct, one of which is acidic and the other one of which is basic. The solution 154 is oxidized at the anode 158 while the solution 156 is reduced at the cathode 160 without the fiber electrodes polarizing. In practice the porous membrane 152 need not be ion selective. Consequently, the membrane 152 is relatively inexpensive and does not require high electrical energy.

The bipolar cell is particularly well suited for use where the anolyte and catholyte are to be kept separate, where oxidation or reduction in either side of the cell may be ionic, or where a polarized electrode is desired.

The invention in its broader aspects is not limited to the specific described embodiments and departures may be made therefrom within the scope of the accompanying claims without departing from the principles of the invention and without sacrificing its chief advantages.

What is claimed is:

1. In a process for making a fiber containing electrode, comprising:

providing a continuous length of a plurality of semi-metallic core fibers;

plating at least an end of each of the core fibers with a substantially uniform, firmly adherent coating of metal, positioning an electrical connector for contact with the metal coated ends of said core fibers, and joining the metal coated ends and the electrical connector by an electrically conductive metal which extends between said metal coated fiber ends to form an integral fiber/metal matrix which provides an efficient electrical connection.

2. The process as defined in claim 1, wherein the metal coating extends substantially along the entire length of the core fibers.

3. The process as defined in claim 2, wherein the core fibers are semi-metallic, and wherein the metal coating on the core fibers spaced from the fiber/metal matrix is removed.

4. The process as defined in claim 3, wherein the core fibers are carbon and the metal coating is nickel, and wherein the coating is removed from the core fibers by immersing the fibers in nitric acid.

5. The process as defined in claim 4, wherein the electrically conductive metal which joins the metal coated fibers and the electrical connector is solder.

6. The process as defined in claim 1, wherein the joining of the metal coated fibers and the electrical connector is accomplished by immersing the assembly in molten solder.

7. The process as defined in claim 6, wherein the metal coated fibers are immersed for about 10 seconds.

8. The process as defined in claim 1, wherein the continuous length of metal coated fibers joined to the connector by the integral fiber/metal matrix are mounted on a flow-through support.

9. The process as defined in claim 8, wherein the continuous length of said fibers is wrapped around the flow-through support.

10. The process as defined in claim 9, wherein the metal coated fibers are in the form of a tow and the tow is wrapped around the length of the flow-through support and the fibers extend thereacross.

* * * * *